US006261515B1

(12) United States Patent
Ren et al.

(10) Patent No.: US 6,261,515 B1
(45) Date of Patent: Jul. 17, 2001

(54) METHOD FOR PRODUCING RARE EARTH MAGNET HAVING HIGH MAGNETIC PROPERTIES

(76) Inventors: Guangzhi Ren, 8 Yibing Dao, Nankai District; Fu Fang; Zhiliang Dai, both of 2-3-35 Hua-Ning-Bei-Li, Nankai District, all of Tianjin City (CN)

( * ) Notice: Subject to any disclaimer, the term of this patent is extended or adjusted under 35 U.S.C. 154(b) by 0 days.

(21) Appl. No.: 09/259,203

(22) Filed: Mar. 1, 1999

(51) Int. Cl.[7] ..... B22F 3/02
(52) U.S. Cl. ..... 419/66
(58) Field of Search ..... 419/38, 66; 148/301, 148/302, 306

(56) References Cited

U.S. PATENT DOCUMENTS

| | | | | |
|---|---|---|---|---|
| 4,402,770 | | 9/1983 | Koon . | |
| 4,588,439 | | 5/1986 | Narasimhan et al. . | |
| 4,597,938 | | 7/1986 | Matsuura et al. . | |
| 4,601,875 | | 7/1986 | Yamamoto et al. . | |
| 4,684,400 | | 8/1987 | Ritsko et al. . | |
| 4,802,931 | | 2/1989 | Croat . | |
| 4,865,915 | * | 9/1989 | Okonogi et al. | 428/336 |
| 4,878,964 | | 11/1989 | Mizoguchi et al. . | |
| 4,994,109 | | 2/1991 | Willman et al. . | |
| 5,064,465 | | 11/1991 | Chen et al. . | |
| 5,127,970 | | 7/1992 | Kim . | |
| 5,129,964 | | 7/1992 | Anderson . | |
| 5,143,560 | | 9/1992 | Doser . | |
| 5,167,914 | * | 12/1992 | Fujimura et al. | 419/11 |
| 5,172,751 | | 12/1992 | Croat . | |
| 5,217,543 | * | 6/1993 | Inokoshi | 148/302 |
| 5,244,510 | | 9/1993 | Bogatin . | |
| 5,282,904 | | 2/1994 | Kim et al. . | |
| 5,338,371 | | 8/1994 | Nakayama et al. . | |
| 5,474,623 | | 12/1995 | Ma et al. . | |
| 5,486,239 | | 1/1996 | Nakayama et al. . | |
| 5,650,021 | | 7/1997 | Takahashi . | |
| 5,858,123 | * | 1/1999 | Uchida et al. | 148/302 |
| 5,888,416 | * | 3/1999 | Ikuma et al. | 252/62.54 |

FOREIGN PATENT DOCUMENTS

| | | |
|---|---|---|
| 4-152611 | 5/1992 | (JP) . |

* cited by examiner

*Primary Examiner*—Daniel Jenkins
(74) *Attorney, Agent, or Firm*—Chan Law Group LC

(57) ABSTRACT

A method for producing rare earth magnets that results in the magnet having substantially enhanced magnetic properties. This innovative production method reduces the ability of the rare earth-containing magnetic powder, such as an alloy of neodymium, dysprosium or a combination of neodymium and dyprosium, along with iron and boron, to react with oxygen-containing sources during the molding step of production by carrying out the molding step in an isolated environment, wherein the humidity level and the oxygen content, is controlled and minimized. The magnetic powder is also isolated from contact with oxygen-containing sources prior to molding to prevent oxidation as well as during magnetic alignment and compression of the magnet.

12 Claims, 3 Drawing Sheets

METHOD FOR PRODUCING RARE EARTH MAGNET HAVING HIGH MAGNETIC PROPERTIES

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention pertains generally to magnetic materials, and more particularly to a method for producing rare-earth magnets that have improved magnetic properties.

2. Description of the Background Art

Rare earth magnets are utilized in a wide variety of applications, ranging from motors, magnetic bearings, magnetic couplings, speakers, microphones, signal recording devices, instrumentation, switches, and relays to charged particle beam guidance, nuclear magnetic resonance image-forming equipment and particle accelerators.

A class of rare earth magnets, composed of a formulation of neodymium (Nd), iron (Fe) and boron (B), are the most powerful magnets available. They have high residual inductance (Br), high maximum energy product ($BH_{max}$) and relatively high intrinsic coercivity ($H_{ci}$). These magnets, known as the neodymium-iron-boron Rare earth magnets ($Nd_2Fe_{14}B$), provide the best magnetic properties in terms of high energy product. With its excellent magnetic properties, abundant raw material for its manufacture, and a relatively low manufacturing cost, use of the $Nd_2Fe_{14}B$ rare earth magnets in applications requiring high magnetic properties are becoming almost universal. Rare earth-containing magnets are typically produced by crushing a rare earth-containing alloy into magnetic powder, forming and molding the magnetic powder into magnetic bodies (known as green compacts), sintering and heat-treating the green compacts.

Due to it's active chemical nature, however, neodymium is easily oxidized to form $Nd_2O_3$. Research has shown that the oxidation of neodymium in the magnet is seriously destructive to the properties of rare earth-containing magnets. The oxygen content of neodymium-iron-boron rare earth magnets is the key factor affecting the magnet's properties. $Nd_2O_3$, which is formed through the reaction of neodymium with $O_2$, has anti-magnetic characteristics and detrimental to the overall magnetic properties of $Nd_2Fe_{14}B$ rare earth magnets. Thus, reducing the oxygen content in the magnet effectively improves the magnetic properties of neodymium-iron-boron rare earth magnets because the $Nd_2O_3$ content is correspondingly reduced. Reducing the percentage of $Nd_2O_3$ in the major phase of $Nd_2Fe_{14}B$ will also result in a reduction of volume and weight of the magnet, thus allowing for miniaturization at a very economical cost without sacrificing performance.

Accordingly, there is a need for a cost-effective method for manufacturing rare earth containing magnets that consistently reduces and/or controls the ability of oxygen-containing sources to react with the magnetic powder during the manufacture of the rare earth containing magnet. The present invention satisfies this need, as well as others, and generally overcomes the deficiencies found in the background art.

BRIEF SUMMARY OF THE INVENTION

The present invention pertains to a method for producing rare earth-containing magnets that results in the magnet having substantially enhanced magnetic properties. This innovative production method reduces the ability of the rare earth element, namely neodymium, dysprosium, or a combination of neodymium and dysprosium, to react with oxygen-containing sources prior to and during the molding, aligning in a magnetic field and compressing steps of the manufacturing process by isolating the magnetic powder and the formed magnet from oxygen-containing sources, wherein the humidity level and the oxygen content, is minimized and controlled.

The method of the present invention is based on the fact that environmental humidity oxidizes with neodymium in a rare earth-containing magnet to form $Nd_2O_3$. $Nd_2O_3$ is generally formed in two ways: (1) by chemical reaction between neodymium and oxygen from the surrounding air, and (2) by chemical reaction between neodymium and $H_2O$ present in environmental humidity.

Besides neodymium, the iron in rare earth-containing magnets also react with oxygen. Iron can be oxidized through direct contact with oxygen in the surrounding air and also through chemical reaction with $H_2O$ present in environmental humidity during the manufacturing process. Therefore, the reduction of environmental humidity during the manufacture of the rare earth-containing magnet is essential in reducing anti-magnetic $Nd_2O_3$ along with all other oxidized phases of the magnet.

The method for producing rare earth magnets according to the present invention generally comprises the steps of vacuum-packing magnetic powder into sealed packages, forming and molding the magnetic powder in an isolated environment wherein the humidity level within the isolated environment is maintained consistently below 40% and the oxygen content is maintained below 1%, aligning magnetically the formed magnet while the formed magnet is isolated from direct contact with the surrounding environment and compressing the formed magnet while the formed magnet is isolated from direct contact with the surrounding environment.

The present invention is easily incorporated into existing methods for manufacturing rare earth-containing magnets, which typically include the steps of crushing or pulverizing a rare earth-containing alloy into a magnetic powder, forming and molding the magnetic powder, magnetically aligning the molded and formed magnetic powder, compressing the magnetic powder to form a magnetic body or green compact, and sintering and heat treating the green compact.

The isolated environment generally comprises an enclosure, operating portals, an inlet/outlet window, molding bases and pressure-sealed molding covers disposed within the enclosure, a humidity meter, means for supplying inert gas into the enclosure and desiccating agents disposed between the inert gas supply means and the enclosure, along with desiccating agents within the enclosure.

As a result of reducing the humidity level and oxygen content throughout the forming and molding step, and isolating the green compact from the surrounding environment during magnetic alignment and compression, oxidation of the magnetic powders and green compacts is minimized, and the magnetic properties of the rare earth magnet are substantially improved, such that the maximum energy product ($(BH)_m$) is increased by at least 3–5 MGOe and the intrinsic coercivity ($H_{ci}$) is increased by at least 2–4 KOe and the working temperature is increased approximately 30° C. to 50° C. Rare earth magnets produced according to this invention have a composition of major phase, $Nd_2Fe_{14}B \geqq 96\%$ (which contains <0.6% oxygen by weight); rich neodymium phase <3%; and rich boron phase <1%.

An object of the invention is to provide a method for producing rare earth-containing magnets that have a reduced oxygen content.

Another object of the invention is to provide a method for producing rare earth-containing magnets that minimizes and controls the humidity level and oxygen content of the manufacturing environment during forming and molding.

Another object of the invention is to provide a method for producing rare earth-containing magnets that isolates the formed magnet during aligning and compressing of the magnetic body.

Still another object of the invention is to provide a method for producing rare earth magnets that minimizes the oxidation of the formed magnet during sintering.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
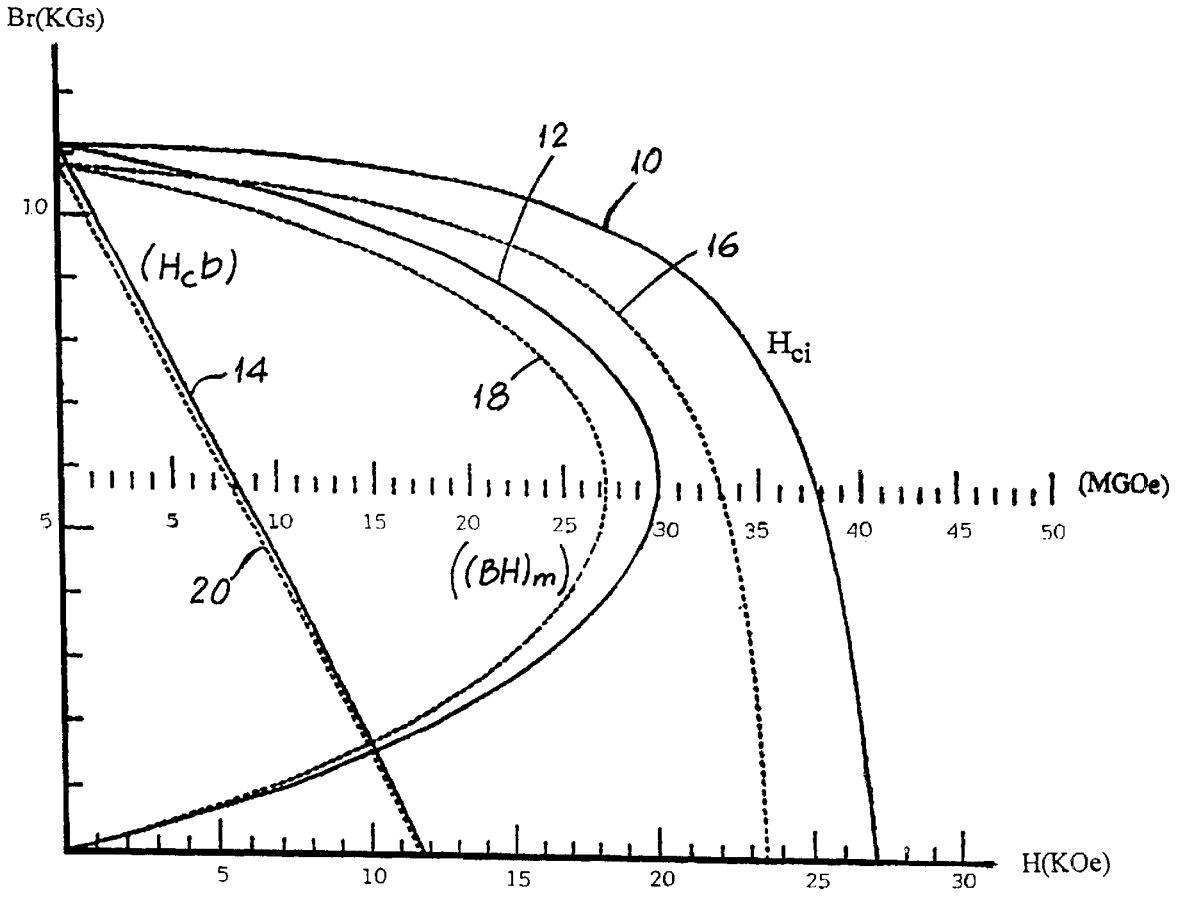
FIG. 1 is a graph showing the relationship between residual induction on the vertical axis and the coercivity, $H_{ci}$ (KOe), as well as the maximum energy product, BH(m), on the horizontal axis for rare earth-containing magnets manufactured under different humidity conditions.
Figure 2:
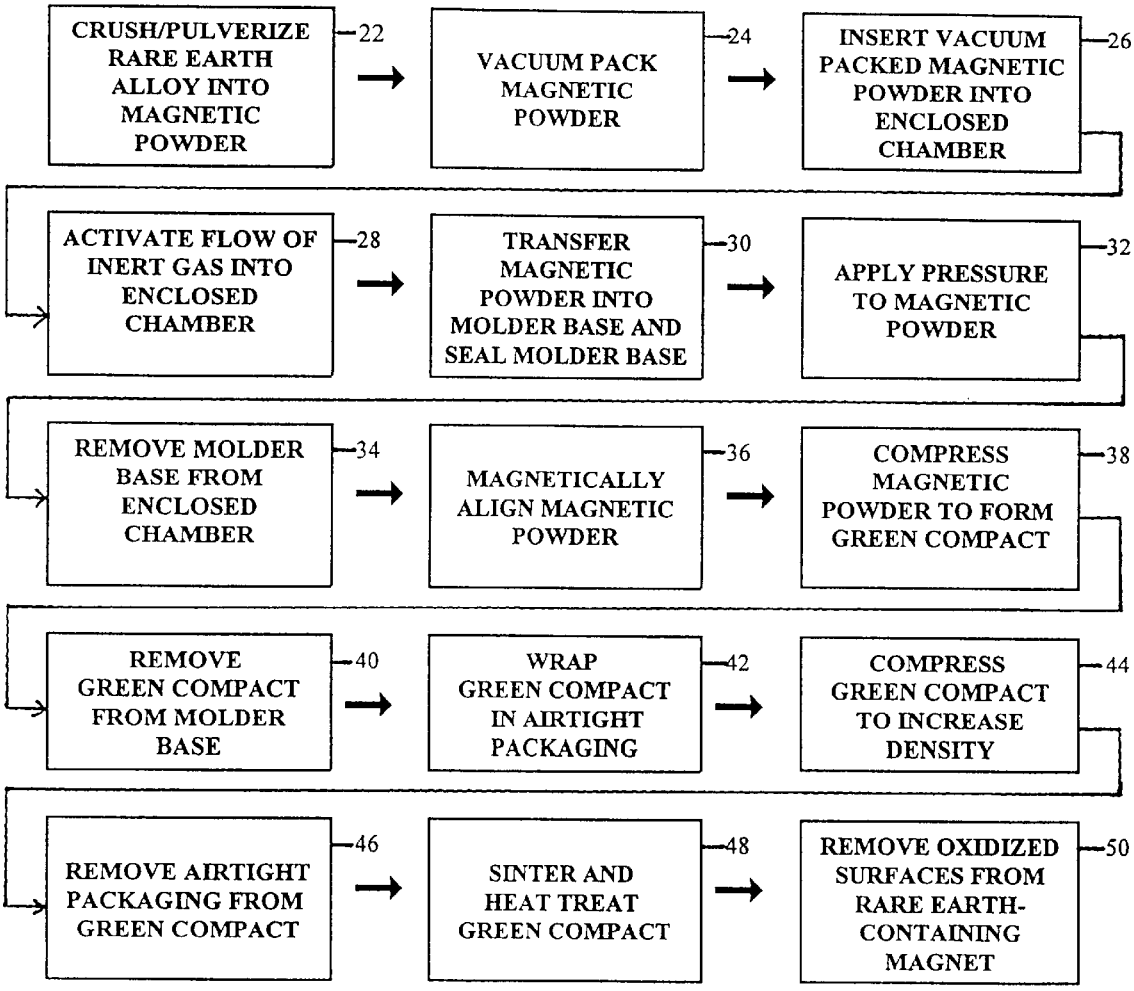
FIG. 2 is a flowchart showing the general method for manufacturing a rare earth-containing magnet, which includes the preferred method of the present invention.
Figure 3:
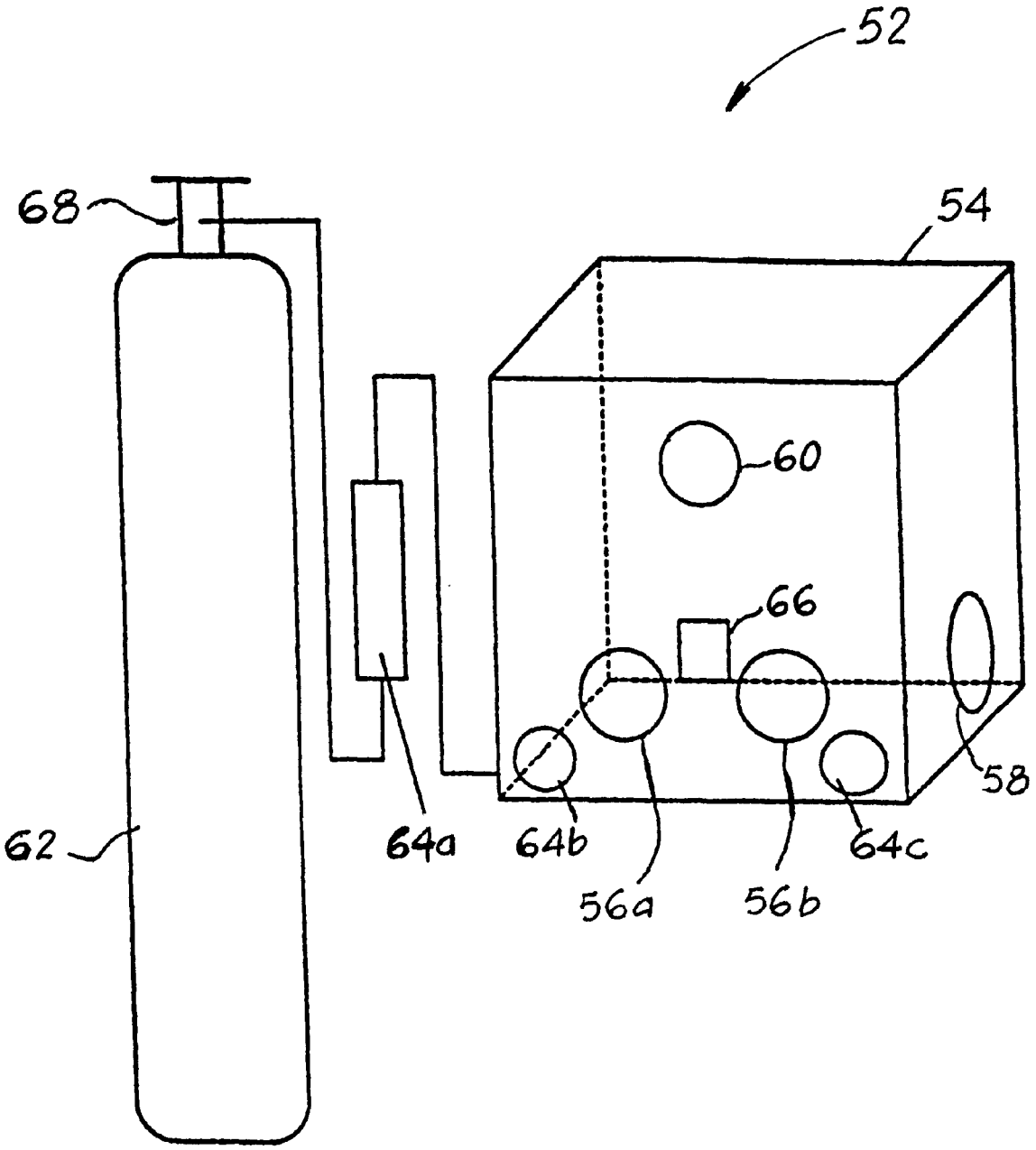
FIG. 3 is a schematic representation of a preferred embodiment of the isolated environment in accordance with the present invention.

Referring more specifically to the drawings, for illustrative purposes the present invention is embodied in the method generally shown in FIG. 1 through FIG. 3. It will be appreciated that the method may vary as to steps and as to details of the steps without departing from the basic concepts as disclosed herein.

This invention is a method for producing rare earth-containing magnets, that results in the magnet having a reduced oxygen content. As a result of having a lower or reduced oxygen content, the combined total maximum energy product and intrinsic coercivity is increased to approximately over 55. Such improved magnetic properties of rare earth-containing magnets are accomplished by isolating the magnetic powder and reducing and maintaining the surrounding environmental humidity during the manufacturing process of the rare earth-containing magnet. Preferably, the relative humidity is consistently maintained below approximately 40% and oxygen content below approximately 1% during the manufacturing step of forming and molding the magnetic powders into green compacts or magnetic bodies. The formed or molded magnet (green compact) is also isolated from direct contact with the surrounding environment.

As a result of consistently maintaining the relative humidity below approximately 40% and the oxygen content below 1% during the forming and molding of the magnetic powder, as well as isolating the green compact, a neodymium rare earth-containing magnet (NdFeB) has a major phase $Nd_2Fe_{14}B$ greater than or equal to 96% by weight (which contains less than 0.6% oxygen by weight), rich neodymium phase less than or equal to 3% by weight and rich boron phase less than or equal to 1% by weight.

The oxygen content of rare earth-containing magnets is a critical factor affecting the magnetic properties of the magnet. It has been shown that if the oxygen content of the rare earth-containing magnets is between 4000–6000 ppm, its maximum energy product is approximately 35 MGOe; if the oxygen content is below 4000 ppm, its max energy product increases to approximately 40 MGOe; and if the oxygen content is below 1800 ppm, its maximum energy product increases to approximately 50 MGOe.

Due to its chemical nature, a rare earth element such as neodymium is very easily oxidized. Oxidation of neodymium occurs primarily in two instances during the manufacture of a NdFeB magnet. The first instance of oxidation is by immediate reaction between oxygen present in the environment surrounding the neodymium alloy magnetic powders. The second instance of oxidation is the reaction between $H_2O$ from the surrounding environmental humidity and neodymium alloy magnetic powders. Some of this oxidation occur upon immediate contact between the magnetic powder and $H_2O$ in the surrounding environmental humidity, however, most of the oxidation in the second instance occurs within the sintered compact during the sintering process. Thus, reducing the final oxygen content in rare earth-containing magnets as low as possible is an effective method for achieving a rare earth-containing magnet that possesses high magnetic properties.

The inventors have determined that the oxygen content of a rare earth-containing magnet is directly related to the particle size of the magnetic powders, as shown in Table 1.

TABLE 1

| Diameter (μm) | >1000 | >63 | >35 | >20 | >11 | >7 | >4.8 | >3.2 |
|---|---|---|---|---|---|---|---|---|
| Oxygen (ppm) | 400 | 800 | 1100 | 1500 | 1800 | 2800 | 4200 | 6100 |

The inventors have further determined that differences in the surrounding environmental humidity level during the manufacture of a NdFeB magnet affect the properties of the magnet, as shown in Table 2.

TABLE 2

| Humidity (%) | $H_2O$ (g/kg) | Nd (Weight %) | Maximum Energy Product (MGOe) |
|---|---|---|---|
| 90 | 27.5 | 36–37 | 27–29 |
| 85 | 24.5 | 35–36 | 28–30 |
| 80 | 21.7 | 35–35.5 | 28–32 |
| 40 | 9.8 | 30 | 33–35 |

Thus, it can be seen that the lower the humidity level during manufacturing, the greater the maximum energy product, along with a lower neodymium weight.

A lower humidity level during manufacturing reduces Nd weight because the more $H_2O$ that is present from surrounding environmental humidity, the more $Nd_2O_3$ is produced from the reaction between neodymium and the $H_2O$. As a result, the oxygen content of the NdFeB magnet is higher, which causes the reduction in the maximum energy product.

The following tables show the performance characteristics of rare earth-containing magnets manufactured using the invention, under different humidity and temperature conditions, wherein the alloy of the magnetic powders is represented by the following formula: $(Nd_{1-x}Dy_x)(Fe_{0.92}B_{0.08})_{5.8}$, x=0–0.2.

In Table 3: x=0.12, Nd=28.0%, Dy=4.4%, Fe=66.6%, Boron=1.0%, and oxygen content <6000 ppm, sample B/E/H with $T_w$° C.; <150° C.: sample A/D/G with reduced $T_w$° C.: <120° C. and increased oxygen content >0.6% in weight percent; and sample C/F/I with $T_w$° C.: <150° C. and lower oxygen content <0.6% in weight percent.

TABLE 3

| Relative Humidity Temperature | 85% 30° C. | | | 55% 20° C. | | | 40% 30° C. | | |
|---|---|---|---|---|---|---|---|---|---|
| Properties & Characters | Br KGs | Hci KOe | (BH)m MGOe | Br KGs | Hci KOe | (BH)m MGOe | Br KGs | Hci KOe | (BH)m MGOe |
| Sample A/B/C | 10.4 | 17.1 | 27.3 | 10.8 | 20.2 | 29.1 | 11.4 | 22.1 | 31.5 |
| Sample D/E/F | 10.5 | 18.2 | 27.8 | 11.0 | 20.8 | 30.0 | 11.5 | 22.4 | 31.6 |
| Sample G/H/I | 10.8 | 19.0 | 28.1 | 10.9 | 20.9 | 29.6 | 11.5 | 22.1 | 31.5 |

In Table 4, x=0.2, Nd=25.5%, Dy=7.2%, Fe=66.2%, Boron=1.1%, and oxygen content <6000 ppm, sample K/N/Q with $T_w$° C.<200° C.; sample J/M/P with reduced $T_w$° C.<150° C. and increased oxygen content >0.6% in weight percent; sample L/O/R with $T_w$° C.<200° C. and lower oxygen content <0.6% in weight percent.

TABLE 4

| Relative Humidity Temperature | 90% 30° C. | | | 50% 20° C. | | | 40% 30° C. | | |
|---|---|---|---|---|---|---|---|---|---|
| Properties & Characters | Br KGs | Hci KOe | (BH)m MGOe | Br KGs | Hci KOe | (BH)m MGOe | Br KGs | Hci KOe | (BH)m MGOe |
| Sample J/K/L | 10.6 | 23.0 | 27.1 | 10.7 | 25.3 | 28.1 | 11.1 | 26.8 | 29.8 |
| Sample M/N/O | 10.7 | 23.5 | 27.3 | 10.8 | 25.4 | 28.2 | 11.2 | 27.0 | 30.0 |
| Sample P/Q/R | 10.6 | 23.1 | 27.2 | 10.8 | 25.4 | 28.2 | 11.1 | 26.8 | 29.8 |

In Table 5, x=0.09, Nd=29.24%, Dy=3.25%, Fe=66.4%, Boron=1.11%, and oxygen content <6000 ppm, sample T/W/Z with $T_w$° C.<120° C.; sample S/V/Y with reduced $T_w$° C.<80° C. and increased oxygen content >0.6% in weight percent; sample U/X/ALTHETA with $T_w$° C.<120° C. and lower oxygen content <0.6% in weight percent.

TABLE 5

| Relative Humidity Temperature | 85% 30° C. | | | 55% 20° C. | | | 40% 30° C. | | |
|---|---|---|---|---|---|---|---|---|---|
| Properties & Characters | Br KGs | Hci KOe | (BH)m MGOe | Br KGs | Hci KOe | (BH)m MGOe | Br KGs | Hci KOe | (BH)m MGOe |
| Sample S/T/U | 11.6 | 15.5 | 33.0 | 11.8 | 17.2 | 34.2 | 12.2 | 19.0 | 36.1 |
| Sample V/W/X | 11.7 | 15.8 | 33.1 | 11.9 | 17.4 | 34.5 | 12.1 | 18.8 | 36.0 |
| Sample Y/Z/ALTHETA | 11.6 | 15.8 | 33.0 | 11.8 | 17.25 | 34.3 | 12.1 | 18.9 | 36.0 |

The oxygen content of the rare earth-containing magnet, such as NdFeB, is not solely due to the oxidation of neodymium in NdFeB magnets, but the sum total of neodymium oxidizing, reaction between neodymium and $H_2O$, present in the environmental humidity, forming $Nd_2O_3$, reaction between iron and $H_2O$ present in the environmental humidity, and also from reaction between $H_2O$ present in the environmental humidity with any other rare earth elements that exists in the magnetic alloy.

Sintered rare earth-containing magnets contain complex multiple phases. For a NdFeB magnet, it comprises a major phase ($Nd_2Fe_{14}B$), a rich neodymium phase ($Nd_{95}Fe_5$ and $Nd_4Fe_4B$) a rich boron phase ($Nd_2Fe_7B_6$), an $Nd_2O_3$ phase and an α-iron phase. The major phase ($Nd_2Fe_{14}B$), which comprises approximately 96% of the magnetic body, is the magnetic phase of a sintered NdFeB magnet. This major phase is the primary contributor to the magnet's properties, such as maximum energy product, intrinsic coercivity and residual induction (also known as remanence).

The rich neodymium phase is also a major contributor to the magnet's properties. This phase is in liquid condition during sintering and contributes to the density and uniformity of the magnet's microstructure. During cooling, the rich neodymium phase forms a crystal face $Nd_2Fe_{14}B$ lattice, that improves the magnet's coercivity. In order for NdFeB magnets to achieve a higher coercivity, there must be sufficient rich neodymium phase. The rich neodymium phase is a primary component that helps increase the relative density of the magnet. The increase of magnetic density is based on the content of liquid phase (rich neodymium phase) and temperature of sintering. The density of magnetic body is achieved through the liquid phase effect of rich neodymium phase under high temperature sintering. Therefore, the magnet requires rich neodymium phase to maintain the structural requirement of a high magnetic coercivity and to achieve the desired density.

In order to achieve superior performance in NdFeB magnets, the content of the major phase $Nd_2Fe_{14}B$ should be as high as possible above 96%. Since rich boron phase has non-magnetic characteristics and detracts from the performance of the NdFeB magnet, the rich boron phase is preferably minimized. As percentage of the whole magnet body, the content of the rich boron phase should be maintained at or below 1%.

The $Nd_2O_3$ phase does not contribute to the magnet's overall performance characteristics and even detracts from the NdFeB magnet's performance ability, because the existence of $Nd_2O_3$ reduces magnet's coercivity and maximum energy product. In the event of significant oxidation of the magnet body, the magnetic properties of NdFeB magnet could be lost. The following reaction illustrates the formation of $Nd_2O3$:

| | | | | | |
|---|---|---|---|---|---|
| | 4Nd | + | $3O_2$ | = | $2Nd_2O_3$ |
| | 4 × 144 | | 3 × 2 × 16 | | 2 × (2 × 144 + 3 × 16) |
| | 576 | | 96 | | 672 |
| Units: | 6 | | 1 | | 7 |

This shows that one unit of oxygen will take 6 units of neodymium from the major phase and rich neodymium phase to form 7 units of $Nd_2O_3$. If too much major phase is taken away by oxygen to form $Nd_2O_3$, the content of the major phase will be less than 96%, resulting in a reduction of magnetic properties.

Metal neodymium possesses active chemical characteristics and can be oxidized through direct contact with oxygen or by reaction with oxygen in $H_2O$ from humidity, resulting in the formation of $Nd_2O_3$. The following chemical reaction illustrates the formation of $Nd_2O_3$:

$$4Nd+3O_2=2Nd_2O_3$$

$$2Nd+3H_2O=Nd_2O_3+3H_2$$

There also exist other oxygen-containing compounds such as, $Fe_2O_3$ and $Dy_2O_3$ (if Dy is present in the composition of the magnetic alloy). Iron can be oxidized by direct contact with oxygen and result in FeO and $Fe_2O_3$. Other rare earth elements existing in the composition, such as dysprosium (Dy), can also be oxidized by reacting with $H_2O$ present in the surrounding environmental humidity and resulting in $Dy_2O_3$, at certain temperatures. The iron in NdFeB magnets also possesses very active chemical characteristics and reacts with oxygen to produce FeO and $Fe_2O_3$ as shown by the following chemical reaction:

$$2Fe + O_2 = 2FeO$$

$$4Fe + 3O_2 = 2Fe_2O_3$$

$$Fe + 2H_2O = Fe(OH)_2 + H_2 \rightarrow FeO + H_2O$$

$$2Fe + 6H_2O = 2Fe(OH)_3 + 3H_2 \rightarrow Fe_2O_3 + 3H_2O$$

Pumping an inert gas, such as nitrogen, into a sealed environment is an effective means for reducing the oxygen content from in the surrounding environment, but this does not reduce or eliminate $H_2O$ from the surrounding environmental humidity. Use of mechanical air pumps to insert nitrogen into an enclosed low-oxygen production line reduces the oxygen content of working environment to 1%, however, the effect of absorbing $H_2O$ from the humidity is too low to noticeably reduce the humidity level and hence, the oxygen contained therein.

Neodymium content of the major phase $Nd_2Fe_{14}B$ in rare earth-containing magnets is greater than neodymium content of rich neodymium phase and the rich boron phase. The oxidizing rate of metal neodymium in the major phase is less than that of neodymium from the rich neodymium phase and the rich boron phase. It first reduces the coercivity and then reduces the remanence and maximum energy product.

FIG. 1 is a graph that illustrates the performance characteristics a the rare earth-containing magnet having a composition of the formula $(Nd_{1-x}Dy_x)(Fe_{0.92}B_{0.08})_{5.8}$, x=0–0.2 and oxygen content less than 6000 ppm. The solid lines 10, 12, 14 respectively represent intrinsic coercivity, maximum energy product, and residual induction of the magnet manufactured in an environment of 40% relative humidity. As can be seen, intrinsic coercivity, $H_{ci}$=27 KOe, maximum energy product, (BH)m=30 MGOe; and residual induction, Br=11.2 KGs. The dotted lines 16, 18, 20 respectively represent the performance characteristics of the magnet manufactured in an environment of 90% relative humidity. As can be seen, (BH)m=27.3 MGOe; $H_{ci}$=23.5 KOe and Br=10.7 KGs.

The method for producing a rare earth-containing magnet having high magnetic properties, in accordance with the present invention, generally comprises the steps of (1) isolating the magnetic powder from oxygen containing sources, (2) forming and molding the magnetic powder in an isolated environment, within which the relative humidity level can be adjustably reduced and maintained below 40% and the oxygen content below 1%, and (3) aligning and compressing the magnetic body while the magnetic body is isolated from oxygen-containing sources.

FIG. 2 shows the invention incorporated into the general steps required for manufacturing rare earth-containing magnets. Rare-earth-containing alloys are typically available in the form of ingots. The ingots are prepared from alloys of at least one or two rare earth elements, namely Nd or Dy, along with iron and boron in a composition formula as follows: $(Nd_{1-x}Dy_x)(Fe_{0.92}B_{0.08})_{5.8}$, x=0–0.2, with oxygen content less than 6000 ppm. Higher percentages of Dy will increase the magnet's coercivity. Dy can also be replaced with other rare earth elements at proper ratio.

First, the ingots are crushed or pulverized into magnetic powder using any of several known procedures 22. The crushing or pulverizing process produces ball mill pulvige magnetic powder, jet mill pulvige magnetic powder or the like, depending on the specific procedure. The magnetic powders produced as a result of the crushing or pulverizing process preferably have individual particle diameters of approximately between 3–5 $\mu$m. Since the magnetic powders are comprised of very small particles, there is more total surface exposed to the surrounding environment, thus rendering magnetic powders extremely susceptible to oxidation. The greater dried surface area exposed to the surrounding environment readily allows for the magnetic particles to absorb moisture ($H_2O$) from the surrounding environmental humidity. This is typically known as the "moistening procedure", which generally occurs during all stages of the manufacturing process.

There are purity requirements for raw materials used for rare earth-containing magnets. A surface cleaning method is applied to remove foreign substances, including surface oxygen compounds from raw materials of rare earth/iron/boron. The rare earth-containing alloy is prepared by melting and casting those raw materials into ingots. With the help of the surface cleaning, the oxygen content of the alloys is very low, usually not over 400 ppm.

Second, the magnetic powders must be isolated from direct contact with the surrounding environment to prevent oxidation 24. Oxidation can occur at the outset during the magnetic powder after crushing or pulverizing by reacting with $H_2O$ from the surrounding environmental humidity and in subsequent magnet manufacturing procedures. This isolation of magnetic powders is accomplished by packing the magnetic powder into individually-wrapped packages and vacuum sealing the packages. The specific procedure for packing the magnetic powder may vary according to the equipment available, and the size of the individual packages may vary according to the specific needs of the end product. The individually-wrapped packages can be plastic bags or the like.

Next, the individually-wrapped packages of magnetic powder is placed into an isolated environment for further processing 26. The isolated environment allows the packaging containing the magnetic powder to be removed without exposing the magnetic powders to direct contact with oxygen containing sources and/or humidity present in the surrounding environment. FIG. 3 generally shows the isolated environment used in the method of the present invention and is discussed in greater detail below.

After placing the individually-wrapped packages of magnetic powder into the isolated environment, a flow of inert gas is into the isolated environment is activated 28. The inert gas purges humidity and/or oxygen from the isolated environment. It is also contemplated that the flow of inert gas may be commenced prior to placing the individually-wrapped packages of magnetic powder into the isolated environment 28. The packaging containing the magnetic powder is then removed while in the isolated environment.

Next, the magnetic powder formed by transferring the magnetic powder into molder bases located within the isolated environment 30. The molder bases allow for the molding of the magnetic powder into specific shapes or configurations as required. Molder covers initially compress the magnetic powder within the molder base 32. At this point, the sole exposed surface of the molded is covered and sealed to prevent exposure of the surface.

The molded magnetic powder is then removed from the enclosed environment 34 and undergoes an magnetic alignment procedure 36. The procedures used to align the magnetic powder is known in the art and therefore, not discussed in further detail. However, during magnetic alignment step 36, the molded magnetic powder is further compressed in a static pressure machine which equalizes the magnetic field alignment 38. A magnetic body is subsequently formed, which is also known as green compacts.

When the green compact is formed, the molder base is removed from the green compact 40 and wrapped with airtight packing materials 42. The green compact, while wrapped with airtight packaging material, is further compressed in a static pressure machine to increase and equalize the density of the green compact 44. After this final compression, the airtight packaging material is removed from the green compact 46. During molding/forming step 32, 34 the magnetic powders would be directly exposed to the surrounding atmosphere for extended durations, were it not carried out in an isolated environment, and their microstructures could then be easily oxidized to form $Nd_2O_3$ during subsequent sintering.

The green compact is then sintered 48 in a vacuum chamber for approximately between 1–2 hours at a temperature of approximately between 1000° C.–1150° C. There is a release of gas during the sintering step at a between 600° C.–800° C. During that time, neodymium and $H_2O$ present in the green compact react together to produce $Nd_2O_3$ and release hydrogen. The neodymium also reacts with hydrogen together to produce $NdH_{2.8}$, a compound detrimental to the magnetic properties of the magnet. As the temperature increases, $NdH_{2.8}$ is decomposed and released to hydrogen, and as the temperature increases even further, the negative effect of hydrogen during sintering goes away. After approximately between 1–2 hours at a temperature of approximately between 1000° C.–1150° C., the sintered compact is rapidly cooled to room temperature. It is important to note that during sintering, neodymium and $H_2O$ react to produce $Nd_2O_3$ which remains within the magnet after the manufacturing process is completed. $Nd_2O_3$ increases the oxygen content of whole magnet, and causes the reduction of magnetic properties of rare earth-containing magnets. The sintered compact is then heat-treated at approximately between 850° C.–950° C. for approximately between 1–2 hours and then approximately between 600° C.–700° C. for approximately between 1–2 hours.

The sole exposed surface of the rare earth-containing magnet may have been oxidized after the green compacts are unwrapped from the airtight packaging material and not placed in the vacuum sintering chamber immediately. The oxidized surface can be removed from the rare earth-containing magnet by shaving, milling or a like process 50.

Referring also to FIG. 3, the isolated environment 52 used in the method of the present invention is generally shown. Isolated environment 52 generally comprises an enclosure 54, a pair of operating portals 56*a*, 56*b*, an inlet/outlet window 58, a humidity meter 60, an inert gas supply tank 62, desiccating agents 64*a*, 64*b*, 64*c* and molder bases 66. Enclosure 54 is preferably transparent to allow for viewing any contents placed therein and fabricated from polymethyl metracrylate, or like material. Enclosure 54 is typically sized for a single operator, although it is contemplated that enclosure can also be sized to accommodate multiple operators, as required. In the preferred embodiment of the invention, enclosure 54 is approximately 16 inches long, 14 inches wide and 16 inches high.

Operating portals 56*a*, 56*b* include flexible gloves (not shown) attached thereto that extend into enclosure 54. Operating portals 56*a*, 56*b* have a diameter of approximately between 4 to 6 inches. Gloves are sealed along the periphery of operating portals 56*a*, 56*b*, thereby preventing the escape of gas therethrough. Inlet/outlet window 58 allows for the placement of the magnetic powder into enclosure 54 and also for removal of the magnetic powder.

Inert gas supply tank 62 provides a constant flow of an inert gas, such as nitrogen, into enclosure 54 during magnet manufacturing operations. The flow of inert gas into enclosure 54 creates a positive pressure differential within enclosure 54 and the external environment, thereby purging humidity and oxygen from within enclosure 54 and creating a generally inert gas environment within enclosure 54. The relative humidity level can be reduced below 40% and the relative oxygen to below 1% within the enclosure 54. Since, the inert gas environment is essentially devoid humidity and oxygen, it is ideal for the forming and molding of magnetic powders to minimize oxidation. Those skilled in the art will appreciate that other inert gases can be used in place of nitrogen. The flow of the inert gas is controlled by a valve 68 of like mechanism placed in series between enclosure 54 and inert gas supply tank 62.

Desiccating agents 64*a*, 64*b*, 64*c* are used to remove moisture from enclosure 54. Desiccating agents 64*a*, 64*b*, 64*c* are placed within enclosure 54 and also another in series between inert gas tank 62 and enclosure 54. Inert gas is dried by desiccating agent 64*a* prior to entering enclosure 54. Several types of desiccating agents 64*a*, 64*b*, 64*c* are contemplated, such as $P_2O_5$, $Al_2O_3$, $Mg(ClO_4)_2$, silica gel of change color, waterless $CaCl_2$ and CaO. One or multiple desiccating agents can be used, depending on the amount of time required to reduce the humidity level of enclosure 54 and/or cost factors. The humidity level within enclosure 54 is controlled by varying the flow rate and pressure of inert gas through desiccating agent 64*a* disposed between inert gas supply tank 62 and enclosure 54.

The relative humidity within enclosure 54 is monitored by humidity meter 60 capable of measuring 0%–100% humidity within enclosure 54. An optional oxygen meter 66 (not shown) can be provided to allow monitoring the oxygen content within enclosure.

Accordingly, it will be seen that this invention reduces the oxygen content of rare earth-containing magnets by isolating the magnetic powder and green compact from direct contact with the surrounding environmental humidity during the manufacture of the magnet by vacuum packing and sealing the magnetic powder into packages subsequent to the crushing/pulverizing of the magnetic alloy and forming/molding magnetic powder in an enclosed chamber, wherein the environment within the enclosed chamber is generally devoid of humidity and oxygen. By isolating the magnetic powder from humidity and oxygen during the manufacturing process, there is a minimum of $H_2O$ and oxygen with which Nd, Dy or Fe reacts with, ultimately resulting in the NdFeB magnet body having a reduced oxygen content.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A method for producing a rare earth-containing magnet having reduced oxygen content, comprising the steps of:

(a) isolating magnetic powder from oxygen containing sources, wherein said magnetic powder alloy contains at least one rare earth element, iron and boron, wherein said rare earth element is Nd;

(b) molding said magnetic powder alloy in an isolated environment, wherein the relative humidity level within said isolated environment is below 40% and the oxygen content is below 1%;

(c) wherein said isolated environment comprises an enclosure, said enclosure including at least two operating portals and an inlet window, means for measuring relative humidity within said enclosure, means for supplying an inert gas into said enclosure, desiccating agents disposed within said enclosure, and desiccating agents in flow communication between said inert gas supply means and said enclosure.

2. The method as recited in claim 1, wherein said isolating step comprises vacuum-packing the magnetic powder.

3. The method as recited in claim 1, further comprising Dy.

4. The method as recited in claim 1, wherein said isolated environment further comprises means for measuring oxygen content in said enclosure.

5. The method as recited in claim 1, wherein said enclosure is generally transparent.

6. The method as recited in claim 1, wherein said molding step comprises the steps of:

(a) activating a flow of inert gas into said isolated environment;

(b) transferring said magnetic powder into said isolated environment; and (c) compressing said magnetic powder.

7. The method as recited in claim 1, further comprising the steps of:

(a) aligning magnetically said molded magnetic powder;

(b) compressing said magnetic powder to form a green compact;

(c) sintering the green compact; and (d) heat-treating the sintered compact.

8. A method for producing a rare earth-containing magnet having reduced oxygen content, comprising the steps of:

isolating magnetic powder from oxygen containing sources, wherein said magnetic powder contains dysprosium or iron, neodymium or iron, and boron;

molding said magnetic powder in an isolated environment with an enclosure including at least two operating portals and an inlet window; wherein the relative humidity level within said isolated environment is below 40% and the oxygen content is below 1%;

measuring the relative humidity within said enclosure and;

supplying an inert gas into said enclosure, desiccating agents disposed within said enclosure and in flow communication between said inert gas supply means and said enclosure.

9. The method as recited in claim 8, further including the step of measuring the oxygen content in said enclosure.

10. A method for producing a rare-earth containing magnet containing having reduced oxygen content, comprising the steps of:

isolating magnetic powder from oxygen containing sources, wherein said magnetic powder contains at least one rare-earth element, iron and boron;

molding said magnetic powder in an isolated environment, wherein the relative humidity level within said isolated environment is below 40% and the oxygen content is below 1% said isolated environment including an enclosure, said enclosure including at least two operating portals and an inlet window means for measuring relative humidity within said enclosure and;

supplying an inert gas into said enclosure having desiccating agents disposed within and in flow communication between said inert gas and said enclosure.

11. The method recited in claim 10 wherein said enclosure is transparent.

12. The method recited in claim 10 further including the step of measuring the oxygen content in said enclosure.

* * * * *